United States Patent [19]

Hamilton

[11] 3,955,901

[45] May 11, 1976

[54] MEMBRANE PUMP

[76] Inventor: Thomas W. Hamilton, 27 Clevehurst Close, Stoke Poges, Buckinghamshire, England

[22] Filed: Sept. 23, 1974

[21] Appl. No.: 508,697

[30] Foreign Application Priority Data

Oct. 23, 1973 United Kingdom ..... 49353/73

[52] U.S. Cl. ..... 417/395; 137/525.3

[51] Int. Cl.[2] ..... F04B 43/06; F04B 45/00; F16K 15/00

[58] Field of Search ..... 417/395, 394, 148, 149, 417/87

[56] References Cited

UNITED STATES PATENTS

| | | | |
|---|---|---|---|
| 3,320,970 | 5/1967 | McHenry | 417/148 X |
| 3,514,227 | 5/1970 | Rupp | 417/395 |
| 3,666,379 | 5/1972 | Mitchell | 417/395 |
| 3,781,141 | 12/1973 | Schall | 417/395 |

*Primary Examiner*—Carlton R. Croyle
*Assistant Examiner*—Richard E. Gluck
*Attorney, Agent, or Firm*—Brisebois & Kruger

[57] ABSTRACT

An air pressure-operated membrane pump for pumping a liquid comprises a housing including a chamber which is divided into liquid and air compartments by a floppy flexible membrane extending across it. The air compartment has an air inlet and outlet connected by a duct to the throat of a venturi to which an air supply under pressure is connected. The outlet from the venturi is controlled by a control valve which is itself opened and closed by the movement of the diaphragm to which a closure member of the valve is connected by a control member. When the valve is open, air flows through the venturi and causes air to be drawn from the air compartment of the pump to move the diaphragm in a direction to draw liquid into the liquid compartment in an intake stroke. At the end of this stroke, the part of the membrane to which the control member is fixed moves and closes the control valve. This causes air under pressure to flow from the throat of the venturi into the air compartment to move the diaphragm in a direction to expel liquid from the liquid compartment in a pumping stroke and again at the end of this stroke movement of the diaphragm moves the control member to shut the valve so that the cycle of operations is repeated, the control of operation of the pump thus being effected entirely by the movement of the membrane itself without any external agency.

4 Claims, 7 Drawing Figures

MEMBRANE PUMP

Figure 1:
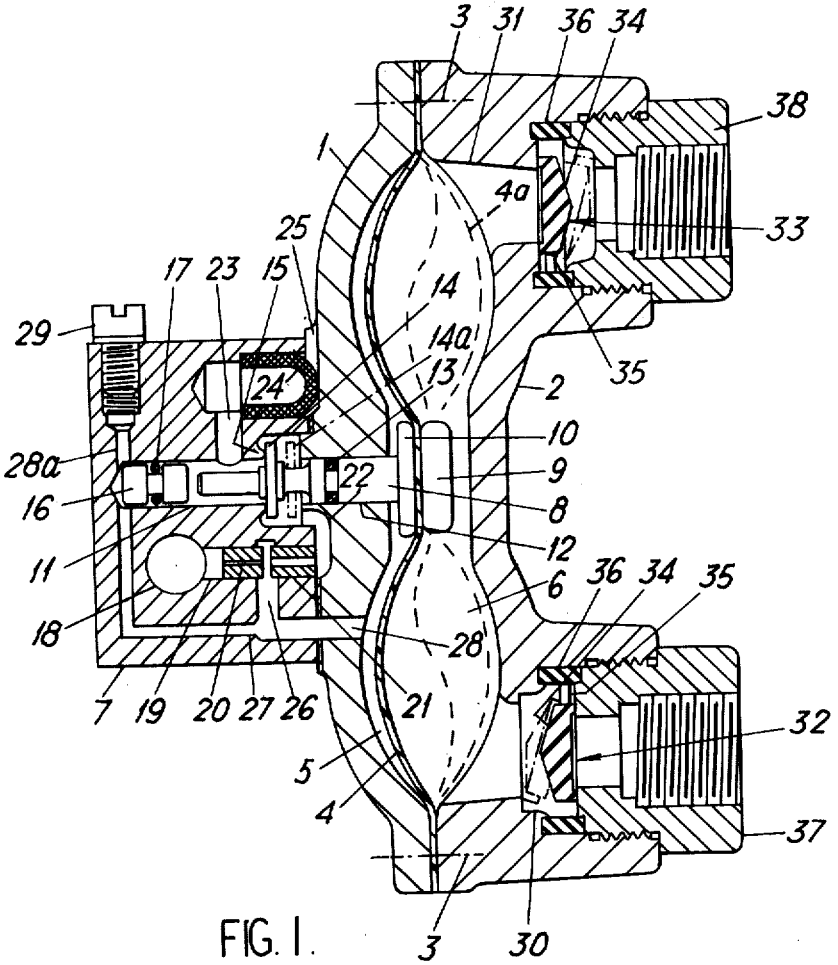

There are two common types of air pressure-operated membrane pumps and in both these types the membrane is in the form of a resilient flexible diaphragm. In one type, the diaphragm bounds one side of a pumping chamber and is moved to and fro mechanically by the piston rod of a double-acting pneumatic cylinder. The piston rod is fixed to the centre of the diaphragm and, when air is admitted to one end of the pneumatic cylinder, the diaphragm is moved in a direction to enlarge the volume of the pumping chamber so that liquid is drawn into the chamber through an inlet. At the end of this stroke of the piston, a valve is mechanically tripped by the movement of the piston rod and this causes the connections to the pneumatic cylinder to be reversed so that the piston is moved back again to move the diaphragm in a direction to reduce the volume of the pumping chamber and expel liquid from it in a pumping stroke.

Pumps of this type have the disadvantage that they are bulky and, because the diaphragm is subjected to pressure on only one side, the diaphragm must be strong and generally therefore relatively stiff. Even so it is subjected to substantial wear so that frequent replacement of the diaphragm is necessary.

In pumps of the second common type, a housing encloses a chamber which is divided by a diaphragm extending across it into two compartments, one of which is a pumping compartment and the other of which is an air pressure compartment. The air pressure compartment has air under pressure admitted to it and then exhausted from it in pulses. These pulses of air under pressure cause the diaphragm to move to and fro to reduce the volume of the pumping compartment to expel liquid from it and then to draw more liquid into the compartment. The return movement of the diaphragm as each pulse of air is exhausted, is usually effected either by the resilience of the diaphragm itself or by a return spring. The supply and exhaust of the pulses of air under pressure into and from the air pressure compartment is generally controlled by a valve arrangement which is separate from the pump and is operated by some external agency. For instance there may be separate solenoid air inlet and exhaust valves which are opened and closed alternately by an electrical control circuit.

Pumps of this second type can be made more compactly and those of the first type, but the valve control is usually expensive particularly when it is necessary to vary the output of the pump frequently in dependence upon the demand for the liquid being pumped.

The aim of the present invention is to provide an air pressure-operated membrane pump for pumping liquids which is both compact and simple so that it can be manufactured inexpensively and, further, which will automatically vary its output in dependence upon the demand placed upon it. That is to say when a liquid outlet from the pump is shut, air under pressure will automatically cease to flow through the pump without it being necessary to perform any separate operation to shut off the air supply.

With this aim in view, in accordance with the present invention, an air pressure-operated membrane pump for pumping a liquid comprises a housing enclosing a chamber, a floppy flexible membrane, that is to say a membrane which is limp and has little or no resilience, dividing the chamber into an air pressure compartment having an air inlet and outlet and a pumping compartment having a liquid inlet and outlet, a control valve for controlling the air supply and exhaust from the air pressure compartment, the control valve having a valve member which is movable between two end positions by a control member which is fixed to and movable by the membrane also between two end positions, and means for restraining the control member and the valve member in both their end positions, the arrangement being such that, in use, when the pump is connected to a pressurised air supply and the valve member and control member are in first end positions with the attachment point of the control member to the membrane displaced into the air pressure compartment, air under pressure is admitted to the air pressure compartment and parts of the membrane spaced from the attachment point are displaced to reduce the volume of the pumping compartment to discharge liquid in a discharge stroke near the end of which the membrane moves the control member against the action of the restraining means from its first end position in the direction of the pumping compartment to its second end position to move the valve member from its first end position into its second end position in which it causes the air to be exhausted from the air pressure compartment so that the parts of the membrane spaced from the attachment point are displaced back to increase the volume of the pumping compartment and admit further liquid in an intake stroke near the end of which the membrane moves the control member against the action of the restraining means in the direction of the air pressure compartment back into its first end position to move the valve member from its second end position back into its first end position in which it allows further air under pressure to be admitted to the air pressure compartment, and so on to cause the membrane to continue to move to and fro.

With this arrangement, the admission and exhaust of the air to cause the pump to function is controlled by the movement of the control member and hence by the movement of the membrane itself so that no external electrical circuitry or valve mechanism operated by an external agency is necessary. By providing a floppy flexible membrane, which, because it has little or no resilience, will not apply any return force to the control member as the membrane is displaced, the valve member and the control member will remain in either one end position or the other under the action of the restraining means to cause the pump to perform either a discharge or an intake stroke until the membrane approaches the end of its movement one way or the other and then becomes taut at its attachment point to the control member. The membrane thus moves the control member against the action of the restraining means only in the last part of its own movement.

The floppy flexible membrane may be in the form of a balloon surrounded by the housing and then the space inside the balloon forms the pumping compartment and the space between the balloon and the wall of the housing forms the air pressure compartment. The balloon is collapsed in a discharge stroke of the pump and expanded again in an intake stroke during which liquid flows into the balloon through an inlet and outlet through the neck of the balloon. In this case the control member may be attached to a part of the balloon diametrically opposite the neck.

Preferably, however, the membrane is in the form of a flexible dished diaphragm which extends across the chamber and has the pumping compartment on one side and the air pressure compartment on the other side. The control member is then fixed to the diaphragm at or near its centre. In operation the diaphragm is displaced to and fro. In the initial part of each movement the part of the diaphragm surrounding the attachment point of the control member is displaced but the center part of the diaphragm remains stationary, and then, near the end of the movement, the diaphragm becomes taut and pulls the control member with it against the action of the restraining means from one end position to the other.

When the liquid inlet of the pumping compartment is supplied with liquid under some small pressure much less than that of the pump delivery, for instance if the pump draws liquid from a reservoir at a higher level than the pump itself, the pressure of the liquid supply will cause the liquid to flow into the pumping compartment and move the dished diaphragm or other floppy membrane in the direction of the air pressure compartment and in so doing exhausts the air from this compartment.

Preferably, however, the pump is arranged so that on its intake stroke it produces a suction head to draw liquid into the pumping compartment. To achieve this, a sub-atmospheric pressure is applied to the air pressure compartment and for this purpose the pump is preferably provided with an air inlet duct for connection to a source of air under pressure and this duct leads to a venturi which has the air inlet and outlet connected to its throat. The valve member is then arranged so that it closes the outlet from the venturi when the member is in its first end position and opens the outlet of the venturi to atmosphere when the member is in its second end position. Thus with the valve member in its first end position, air supplied under pressure to the inlet duct cannot flow straight through the venturi and instead flows through the connection at the throat of the venturi and then through the inlet and outlet into the air pressure compartment so that this is pressurised and the membrane is moved to cause the pump to perform a discharge stroke. When the valve member is moved to its second position, however, the air from the inlet duct is free to flow through the venturi and produces a sub-atmospheric pressure at the throat of the venturi which is transmitted through the connection at the throat to the air pressure compartment. Thus air is sucked from this compartment and the pressure within it is made sub-atmospheric to draw the diaphragm into the air pressure compartment to cause the pump to perform an intake stroke.

It is important for the means for restraining the control member and the valve member in both their end positions to produce a restraining force which is sufficient to allow the part of the flexible dished diaphragm surrounding the point of attachment of the diaphragm to the control member to move in one direction or the other without moving the control member itself. It is also important, though, that the force produced by the restraining means should be sufficiently small to be overcome by the tension in the diaphragm as this approaches the end of its movement without subjecting the diaphragm to undue strain which would cause its life to be short. To comply with this requirement, the restraining means may comprise magnets provided on at each side of the housing and an attachment of the control member to the diaphragm made of ferro-magnetic material while the housing itself is of non-magnetic material. With this arrangement the attachment is attracted to and held by each of the magnets in turn as it moves to and fro in its pumping movements and in consequence the control member and the valve member are both held in their two end positions by the attachment.

Preferably, however, the restraint of the valve member and the control member in their end positions is achieved by the fluid pressures acting on the two sides of the diaphragm or by air pressure acting upon the valve member itself. To effect the restraint in this way, the control member is preferably in the form of a rod which is fixed to the centre of the diaphragm and which extends transversely to the plane in which the periphery of the diaphragm is fixed through an opening in the wall of the part of the housing which bounds the air pressure compartment. The rod is slidable in the opening and is provided with a seal so that the effective area of the face of the diaphragm which is directed towards the air pressure compartment is less than the effective area of the face of the diaphragm which is directed towards the pumping compartment.

Because the diaphragm is floppy, that is to say is limp and has little or no resilience, during operation of the pump, except when the diaphragm becomes taut, the pressure of the liquid in the pumping compartment is the same at any instant as the pressure of the air in the air pressure compartment. Accordingly when air under pressure is admitted to the air pressure compartment during a pumping stroke, the pressure of the liquid will be substantially equal to that of the air and an out-of-balance force, which is equal to the liquid pressure multiplied by the cross-sectional area of the rod, is applied by the liquid to the centre of the diaphragm and this acts to restrain the control rod and the valve member in the first end position. When the diaphragm becomes taut, the pressure of the liquid falls below that of the air and the tension in the diaphragm overcomes the liquid pressure acting over the area of the rod and pulls the rod suddenly in the direction of the liquid pumping compartment to move the control member and the valve member into their second end positions.

A similar state of affairs occurs when the air pressure compartment is subjected to a sub-atmospheric pressure during the intake movement of the diaphragm. At this time, the area of the diaphragm represented by the cross-sectional area of the rod is subjected to the sub-atmospheric pressure pertaining in the liquid, which is substantially equal to the pressure pertaining in the air pressure compartment, but the end of the rod on the side of the opening through the housing remote from the air pressure compartment is subjected to a higher pressure and again therefore there is an out-of-balance force produced on the control rod which holds both the control rod and the valve member in their second end positions.

In some cases, the out-of-balance restraining force produced by the pressure in the liquid, when this is equal to the pressure of the air supply to the pump, may be greater than that which it is desirable to overcome by tension in the diaphragm because the diaphragm has to be floppy and therefore tends to have limited tensile strength. To overcome this difficulty, the control valve may be provided with a freely movable piston which is arranged to act on the end of the control rod remote from the diaphragm or on the valve member and air passages are provided to cause the piston to be acted upon, at its end remote from the control rod, by the same air pressure as that pertaining in the air pressure compartment. The piston is of smaller cross-sectional area than that of the control rod so that the piston applies a force to the control rod which is opposite to, but smaller than, the out-of-balance force which acts on the control rod when the control rod and the valve member are in their first end positions. The force produced by the piston thus reduces but does not completely counteract the restraining force which is produced by the out-of-balance liquid pressure and which has to be overcome by tension in the diaphragm.

As an alternative to this arrangement, the piston may be of the same cross-sectional area as the rod so that the piston applies a force to the control rod which is opposite in direction, but equal in magnitude, to the out-of-balance force which is produced by the liquid pressure and which acts on the control rod when the control rod and the valve member are in the first end position. Since the forces produced by the unbalanced liquid pressure and the piston exactly counterbalance each other, a restraining force to hold the control rod in the first end position is instead provided by air pressure acting upon the valve member itself. To achieve this, the control valve has a seat surrounding an area greater than the cross-sectional area of the control rod and the valve member is a closure member fixed to the control rod and seating on the seat when the valve is in its first end position. When the closure member is on its seat, it closes the air flow through the venturi and the closure member is thus subjected to a force by the pressure of the air supply to the inlet duct acting over an area equal to that bounded by the seat minus the cross-sectional area of the control rod. The control valve is constructed so that this force is of a magnitude necessary to provide the restraint required to hold the control rod and the closure member in their first end positions, but such that it can be overcome without excessive tension in the diaphragm. The actual force required depends upon the size and capacity of the pump and on the air pressure by which it is intended to be operated.

An example of a pump constructed in accordance with the invention will now be described with reference to the accompanying drawings, in which:

FIG. 1 is an axial section through the pump; and,

FIGS. 2*a* to 2*f* are diagrammatic sections similar to FIG. 1, but to a smaller scale and showing the main parts of the pump at successive stages in a cycle of operations.

The pump comprises a circular housing formed by housing parts 1 and 2 which are fixed to each other around their peripheries by a series of set screws, which are not shown, but which extend on a pitch circle indicated by chain-dotted lines 3 through clearance holes in the housing part 1 and are screwed into tapped blind bores in the housing part 2. A floppy circular dished diaphragm 4 has its periphery clamped between the housing parts 1 and 2 and the diaphragm divides a chamber within the housing into an air pressure compartment 5 and a liquid pumping compartment 6. The diaphragm 4 may be made of various limp and flexible sheet materials depending upon the nature of the liquid to be pumped to which the diaphragm must be impervious. A plastics material known as "Viton" which is impervious to most chemicals is used in this example.

A valve block 7 is fixed by set screws, which are not shown, to the outside of the housing part 1 and a control rod 8 has one end fixed to the centre of the diaphragm 4 through clamping flanges 9 and 10 and its other end extending into a central bore 11 in the valve block 7. The control rod 8 slides in a central bore 12 in the housing part 1 and it is sealed in this bore by an O-ring 13.

The control rod 8 carries a valve closure member 14 in the form of a flange, which in this example is made of Neoprene, but may be made of natural rubber or other material of rubber-like resilience. With the control rod 8 in the position shown in FIG. 1, which is its first end position, the closure member 14 seats on an annular valve seat 15 which is of slightly greater diameter than the control rod 8 and thus bounds an area which is a little greater than the cross-sectional area of the rod 8. A piston 16 carrying a sealing O-ring 17 is slidable in the bore 11, which is of the same diameter as the bore 12 and, when moved towards the right from the position shown in FIG. 1 of the drawings, acts on the end of the control rod 8.

An air inlet duct 18 extends laterally into one side of the valve block 7 and is provided with a union for connection to a compressed air supply pipe. The inlet duct 18 communicates with a bore 19 which contains two sleeves 20 and 21. The sleeves 20 and 21 are axially spaced apart from each other and have central bores which are both of much smaller cross section than that of the bore 19, that of the sleeve 20 being substantially smaller than that of the sleeve 21. The bores of the sleeves 20 and 21 together form a venturi and the downstream end, that is the end remote from the inlet duct 18, of the sleeve 21 communicates with a duct 22 which leads to the valve closure member 14 and its seat 15. An air exhaust passage 23 leads from the bore 11 on the downstream side of the closure member 14 through a porous sintered bronze silencing filter 24 to an air exhaust opening 25 formed between the valve block 7 and the housing part 1.

A cross-passage 26 leads from the space between the sleeves 20 and 21, at which the throat of the venturi is situated, to a further passage 27. The further passage 27 leads both to an air inlet and outlet 28 of the air pressure compartment 5 and to the left-hand end of the bore 11 at the left-hand side of the piston 16. A further passage 28*a* leads onwards from the left-hand end of the bore 11 and is normally closed by a screw 29. On removal of the screw 29, a pressure gauge connection can be screwed into the passage 28 for test purposes.

The housing part 2 has a liquid inlet opening 30 and a liquid outlet opening 31. The inlet opening 30 is provided with an inlet-non-return valve 32 and the outlet opening is provided with a similar non-return valve 33. The non-return valves 32 and 33 both have closure-flaps 34 connected by hinge strips 35 to sealing rings 36. The flaps 34, hinge strips 35 and sealing rings 36 are all integrally injection moulded, in this example out of Viton, which, owing to its flexibility, enables the flaps 34 to swing between the positions shown in full lines and those shown in dotted lines in FIG. 1. Unions 37 and 38 are screwed into the inlet and outlet openings 30 and 31 and the sealing rings 36 form seals between the unions 37 and 38 and the portions of the housing part 2 surrounding the inlet and outlet. The flap 34 of the inlet non-return valve seats on an end face of the union 37 and the flap 34 of the outlet non-return valve seats on a face on the housing part 2.

Owing to the unitary construction of the non-return valve flaps 34 and the sealing rings 36, assembly is extremely simple.

In operation, the union of the air inlet duct 18 is connected to a supply of air under pressure the magnitude of which is dependent upon the liquid delivery pressure required and, of course, on what is available. The pressure may vary over wide limits and may for example be 80 psig. The union 37 is connected to a liquid inlet pipe and the union 38 is connected to a liquid delivery pipe.

Figure 2A:
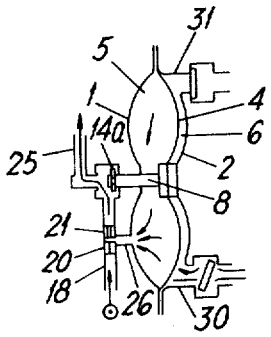

Initially the diaphragm 4 may be in the position shown in FIG. 2*a*, which is the position shown in dotted lines at 4*a* in FIG. 1. With the diaphragm in this position, the valve closure member is moved towards the right from the position shown in FIG. 1 in full lines to that shown in dotted lines at 14*a*. Thus the closure member 14 is off its seat 15 and air is able to flow through the venturi formed by the sleeves 20 and 21 past the closure member 14 to the exhaust outlet 25. This produces a sub-atmospheric pressure in the cross-passage 26 and hence in the air pressure compartment 5. It also produces a similar sub-atmospheric pressure in the duct 27 which moves the piston 16 into the position shown in FIG. 1 of the drawings and holds it there.

The sub-atmospheric pressure in the compartment 5 produces a similar sub-atmospheric pressure in the pumping compartment 6 owing to the floppiness or limpness of the diaphragm 4. The diaphragm in consequence moves from the position shown in FIG. 2*a* through the position shown in FIG. 2*b* and draws liquid into the compartment 6 through the inlet 30.

Figure 2B:
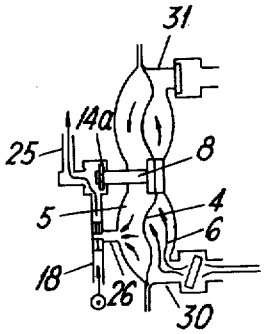
Figure 2C:
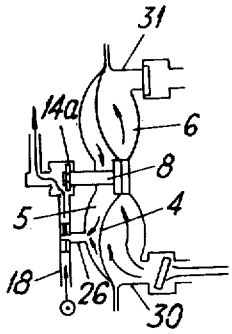

As the parts of the diaphragm 4 between its centre and its periphery, which is clamped, move, the centre of the diaphragm together with the control rod 8 and the valve closure member 14 are restrained in the position shown in FIGS. 2*a* to 2*c*, which forms a second end position, by an out-of-balance force produced by the air pressure within the bore 11 and the duct 11 and the duct 22 acting over the end area of the control rod 8. This force is not balanced bacause the area of the right-hand end of the control rod 8 is subjected only to the sub-atmospheric pressure pertaining in the liquid in the compartment 6.

Figure 2D:
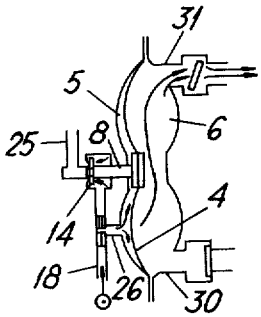
Figure 2E:
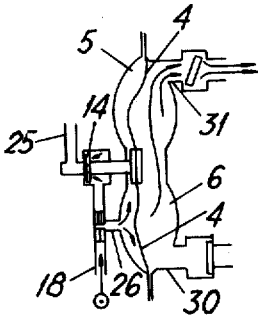
Figure 2F:
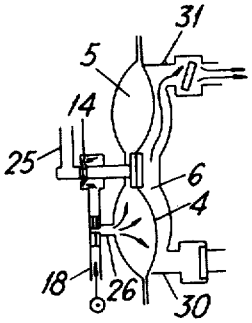

When the diaphragm 4 has moved into the position shown in FIG. 2*c*, it becomes taut and pulls the control rod 8 against the out-of-balance restraining force into its first end position as shown in FIGS. 2*d* to 2*f*. This moves the valve closure member into its first end position in which it seats on the seating 15. This closes the outlet from the sleeve 21 so that instead of having a sub-atmospheric pressure at the throat of the venturi, the pressure rises to that of the air supply. In consequence air under pressure flows into the compartment 5 and starts to move the diaphragm 4 towards the right through the position shown in FIG. 2*e* and this pressurises the liquid in the compartment 6 closing the inlet non-return valve and causing the liquid to flow in a delivery stroke through the outlet 31. During this movement there is a force towards the left on the control rod 8 produced by the pressure of the liquid in the compartment 6 acting over the area of the right-hand end of the rod 8. However, this pressure is equal to the air pressure in the compartment 5 and this same pressure is present in the duct 28 and acts on the piston 16, which is of the same cross-sectional area as the control rod 8. The piston 16 is thus moved into contact with the left-hand end of the control rod 8 and exerts a force upon it which balances that produced by the liquid pressure.

Nevertheless, during the movement of the diaphragm 4 towards the right as shown in FIG. 2*e* the control rod 8 and the valve closure member 14 are restrained in the first end position by the air pressure within the duct 22 acting over the difference between the area of the closure member 14 bounded by the seat 15 and the cross-sectional area of the control rod 8, the former being slightly greater.

When the diaphragm reaches the position shown in FIG. 2*f*, which is that shown at 4*a* in FIG. 1, it again becomes taut and pulls the control rod 8 and with it the valve closure member 14 against the out-of-balance restraining force back into the second end position shown in FIG. 1.

As shown in FIG. 2*f*, as the control rod 8 starts to move towards the right from the first end position towards the second end position, the air pressure initially holds the closure member 14 on its seat 15 and this is able to happen owing to the resilience of the rubber or rubber-like closure member. So long as the closure member 14 remains on its seat, the compartment 5 continues to be subjected to air pressure so that the diaphragm 4 is maintained taut and then suddenly the resilience of the valve closure 14 overcomes the air pressure acting upon it and it moves off its seating 15 with a snap action. This snap action is important because it ensures that the tension in the diaphragm 4 is built up sufficiently to move the control rod 8 rapidly from its first end position to its second end position. Without the snap action, there may be a tendency for the closure member 14 to be moved off its seat thus releasing the air pressure in the compartment 5 before the tension in the diaphragm 4 has been able to move the control rod 8 and the valve closure member 14 into the second end position and should this happen the control rod and valve closure member are left in an intermediate position and the pump will cease to operate.

The balancing piston 16 is provided to ensure that the restraining force holding the control rod 8 in its first end position is not so great as to require excessive tension in the diaphragm 4 to overcome it as this would cause rapid deterioration of the diaphragm. However, when only a much lower liquid delivery pressure is required, making it possible to use a correspondingly lower air supply pressure of, say, 15 psig, the piston 16 together with the duct 28 can be dispensed with.

If at any time during the operation of the pump the liquid demand ceases, for example by closure of a shut-off valve in the delivery pipe connected to the union 38, the pump will automatically cease operation and no further compressed air will be used. If at the time that the demand ceases the pump is performing an intake stroke as shown in FIGS. 2*a* to 2*c*, this stroke will be completed and the control rod 8 and the valve closure member 14 will be moved into the first end position in which the outlet from the venturi is closed. Because the liquid outlet is closed, though, the diaphragm 4 will not be able to move from the position shown in FIG. 2*d* and in consequence the valve closure member 14 will remain in its first end position and the pump will stop. As soon as the liquid discharge is opened again, movement of the diaphragm 4 will start and the cycle of operations will continue as already described. What is more, a low demand for liquid will slow down the rate of operation of the pump and a higher demand will increase it up to a limit dictated by considerations of maximum rates of flow and the size of the pump.

At no time in the operation of the pump is the diaphragm 4 subjected to high differential pressures and it merely forms a separating membrane between the operating air and the pumped liquid.

Although the pump has been described throughout as "air-operated" it can of course if necessary be operated, without any structural modification, by any other compressed gas, for example carbon dioxide.

I claim:

1. A gas pressure-operated membrane pump for pumping liquids, said pump comprising a housing defining a chamber, a limp flexible membrane in said chamber, a gas pressure compartment on one side of said membrane within said chamber, a liquid pumping compartment on the other side of said membrane within said chamber, means defining a gas inlet and outlet to said gas pressure compartment, means defining a liquid inlet and outlet to said pumping compartment, control valve means for controlling the gas supply and outlet from said gas pressure compartment, said control valve including a valve member and means operatively connected to said valve member for moving said valve member between first and second end positions, said means for moving said valve member including a control member and means attaching said control member to said membrane for movement of said control member by said membrane between first and second end positions corresponding to said first and second end positions of said valve member, means for restraining said control member and said valve member in both said first and second end positions, whereby, when said pump is connected to a pressurized gas supply and said valve member and said control member are in said first end positions wherein said means attaching said control member to said membrane is displaced within said gas pressure compartment, gas under pressure is admitted to said gas pressure compartment and parts of said membrane spaced from said means attaching said membrane to said control member are displaced to reduce the volume of said pumping compartment to discharge liquid therefrom in a discharge stroke, and shortly before the end of said discharge stroke, said membrane initiates movement said control member, against the action of said restraining means, from said first end position of said control member in the direction of said pumping compartment to said second end position thereof and said control member moves said valve member from said first end position to said second end position thereof wherein said valve member causes said gas to be exhausted from said gas pressure compartment, so that parts of said membrane spaced from said means attaching said membrane to said control member are displaced back to increase said volume of said pumping compartment and admit further liquid to said pumping compartment in an intake stroke, and shortly before the end of said intake stroke, said membrane initiates movement said control member against the action of said restraining means in the direction of said gas pressure compartment back into said first end position of said control member and said control member moves said valve member from said second end position back into said first end position thereof wherein said valve member allows further gas under pressure to be admitted to said gas pressure compartment, said pump further comprising means defining a gas inlet duct for connection to said source of gas under pressure, a venturi including a throat, means communicating said gas inlet duct with said venturi, means communicating said gas inlet and outlet to said throat and means defining a gas outlet from said venturi, said valve member being operatively arranged to close said outlet from said venturi when said valve member is in said first end position thereof and to open said outlet to atmosphere when said valve member is in said second end position thereof whereby when said valve member is in said first end position thereof gas supplied under pressure to said inlet duct pressurizes said gas pressure compartment and when said valve member is in said second end position thereof, gas from said inlet duct flows through said venturi and exhausts gas from said gas pressure compartment through said throat.

2. A gas pressure-operated membrane pump for pumping liquids, said pump comprising a housing defining a chamber, a limp flexible dished diaphragm in said chamber, a gas pressure compartment on one side of said diaphragm within said chamber, a liquid pumping compartment on the other side of said diaphragm within said chamber, means defining a gas inlet and outlet to said gas pressure compartment, means defining a liquid inlet and outlet to said pumping compartment, control valve means for controlling the gas supply and outlet from said gas pressure compartment, said control valve including a valve member and means operatively connected to said valve member for moving said valve member between first and second end positions, said means for moving said valve member including a control member and means attaching said control member to said diaphragm for movement of said control member by said diaphragm between first and second end positions corresponding to said first and second end positions of said valve member, means for restraining said control member and said valve member in both said first and second end positions, whereby, when said pump is connected to a pressurized gas supply and said valve member and said control member are in said first end positions wherein said means attaching said control member to said diaphragm is displaced within said gas pressure compartment, gas under pressure is admitted to said gas pressure compartment and parts of said diaphragm spaced from said means attaching said diaphragm to said control member are displaced to reduce the volume of said pumping compartment to discharge liquid thereform in a discharge stroke, and shortly before the end of said discharge stroke, said diaphragm initiates movement said control member, against the action of said restraining means, from said first end position of said control member in the direction of said pumping compartment to said second end position thereof and said control member moves said valve member from said first end position to said second end position thereof wherein said valve member causes said gas to be exhausted from said gas pressure compartment, so that parts of said diaphragm spaced from said means attaching said diaphragm to said control member are displaced back to increase said volume of said pumping compartment and admit further liquid to said pumping compartment in an intake stroke, and shortly before the end of said intake stroke, said diaphragm initiates movement said control member against the action of said restraining means in the direction of said gas pressure compartment back into said first end position of said control member and said control member moves said valve member from said second end position back into said first end position thereof wherein said valve member allows further gas under pressure to be admitted to said gas pressure compartment, said pump further comprising means mounting said diaphragm in a position extending across chamber with said pumping compartment on one side of said dished diaphragm and said gas pressure compartment on the other side of said diaphragm, and said means attaching said control member is fixed to said diaphragm at or near the center thereof, and said control member comprising a rod, which is fixed to the center of said diaphragm and which extends transversely to said diaphragm, and further comprising means defining an opening through said housing from said gas pressure compartment, said rod being slidably mounted in said opening, and seal means surrounding said rod, whereby the effective area of that face of said diaphragm which is directed towards said gas pressure compartment is less than the effective area of that face of said diaphragm which is directed towards said pumping compartment, so that an out-of-balance force is produced by unbalanced gas and liquid pressure on said diaphragm, said out-of-balance force acting on said rod and constituting said means for restraining said rod and said valve member in at least one of said first and second end positions.

3. A gas pressure-operated membrane pump for pumping liquids, said pump comprising a housing defining a chamber, a limp flexible dished diaphragm in said chamber, a gas pressure compartment on one side of said diaphragm within said chamber, a liquid pumping compartment on the other side of said diaphragm within said chamber, means defining a gas inlet and outlet to said gas pressure compartment, means defining a liquid inlet and outlet to said pumping compartment, control valve means for controlling the gas supply and outlet from said gas pressure compartment, said control valve including a valve member and means operatively connected to said valve member for moving said valve member between first and second end positions, said means for moving said valve member including a control member and means attaching said control member to said diaphragm for movement of said control member by said diaphragm between first and second end positions corresponding to said first and second end positions of said valve member, means for restraining said control member and said valve member in both said first and second end positions, whereby, when said pump is connected to a pressurized gas supply and said valve member and said control member are in said first end positions wherein said means attaching said control member to said diaphragm is displaced within said gas pressure compartment, gas under pressure is admitted to said gas pressure compartment and parts of said diaphragm spaced from said means attaching said diaphragm to said control member are displaced to reduce the volume of said pumping compartment to discharge liquid therefrom in a discharge stroke, and shortly before the end of said discharge stroke, said diaphragm initiates movement said control member, against the action of said restraining means, from said first end position of said control member in the direction of said pumping compartment to said second end position thereof and said control member moves said valve member from said first end position to said second end position thereof wherein said valve member causes said gas to be exhausted from said gas pressure compartment, so that parts of said diaphragm spaced from said means attaching said diaphragm to said control member are displaced back to increase said volume of said pumping compartment and admit further liquid to said pumping compartment in an intake stroke, and shortly before the end of said intake stroke, said diaphragm initiates movement said control member against the action of said restraining means in the direction of said gas pressure compartment back into said first end position of said control member and said control member moves said valve member from said second end position back into said first end position thereof wherein said valve member allows further gas under pressure to be admitted to said gas pressure compartment, said pump further comprising means mounting said diaphragm in a position extending across said chamber with said pumping compartment on one side of said dished diaphragm and said gas pressure compartment on the other side of said diaphragm, and said means attaching said control member is fixed to said diaphragm at or near the center thereof, and said control member comprising a rod, which is fixed to the center of said diaphragm and which extends transversely to said diaphragm, and further comprising means defining an opening through said housing from said gas pressure compartment, said rod being slidably mounted in said opening, and seal means surrounding said rod, whereby the effective area of that face of said diaphragm which is directed towards said gas pressure compartment is less than the effective area of that face of said diaphragm which is directed towards said pumping compartment, so that an out-of-balance force is produced by unbalanced gas and liquid pressure on said diaphragm, said out-of-balance force acting on said rod and constituting said means for restraining said rod and said valve member in at least one of said first and second end positions, and said control valve means including means mounting said valve member on said rod and freely movable piston means beyond the end of said rod remote from said diaphragm and operatively mounted to actuate said rod and valve member, and said pump further comprises means defining gas passages placing said piston means in communication with said gas pressure compartment, whereby said piston means is acted upon by gas under a pressure equal to that pertaining in said gas pressure compartment, said piston means being of the same cross-sectional area as said rod whereby said piston means applies a force to said rod which is opposite in direction, but equal in magnitude, to said out-of-balance force which acts on said rod when said rod and said valve member are in said first end positions, and said control valve means further comprising seat means surrounding an area greater than said cross-sectional area of said rod and said valve member including closure means fixed to said rod and seating on said seat means when said valve member is in said first end position thereof, whereby a force produced by gas pressure acting on said closure means within said area bounded by said seat produces a force which forms said means for restraining said control member and said valve member in said first end positions thereof.

4. A pump as claimed in claim 3 in which said closure means comprises a flange of material of rubber-like resilience projecting radially from said rod.

* * * * *